US005329756A

United States Patent [19]

Meroni et al.

[11] Patent Number: 5,329,756

[45] Date of Patent: Jul. 19, 1994

[54] AUTOMATIC DEVICE FOR STARTING A TWO-FOR-ONE TWISTING STATION AFTER INTERRUPTION OF THE FEED YARN AND RELATIVE AUTOMATIC PROCESS

[75] Inventors: Roberto Meroni; Umberto Gerin, both of Pordenone; Fabio Lancerotto, Milan; Vittorio Colussi, Pordenone, all of Italy

[73] Assignee: Savio S.p.A., Pordenone

[21] Appl. No.: 884,216

[22] Filed: May 11, 1992

Related U.S. Application Data

[63] Continuation of Ser. No. 520,547, May 8, 1990, abandoned.

[30] Foreign Application Priority Data

May 11, 1989 [IT] Italy ..... 20445 A/89

[51] Int. Cl.[5] ..... D01H 9/10; D01H 9/18; B65H 67/04

[52] U.S. Cl. ..... 57/269; 57/22; 57/58.52; 57/261; 57/270; 57/279; 57/281

[58] Field of Search ..... 57/22, 58.52, 261, 264, 57/268–269, 270–271, 279, 281; 242/35.5 A

[56] References Cited

U.S. PATENT DOCUMENTS

| | | | |
|---|---|---|---|
| 3,619,999 | 11/1971 | Escursell-Prat | 57/261 |
| 3,855,771 | 12/1974 | Yoshizawa et al. | 57/269 |
| 3,939,633 | 2/1976 | Lossa | 57/261 |
| 4,127,983 | 12/1978 | Munker | 57/279 |
| 4,137,700 | 2/1979 | Munker | 57/279 |
| 4,322,943 | 4/1982 | Rohner et al. | 57/261 |
| 4,539,803 | 9/1985 | Ferro et al. | 57/263 |
| 4,716,718 | 1/1988 | Gobbels et al. | 57/264 X |
| 4,878,342 | 11/1989 | Kawarabashi | 57/281 X |
| 4,928,476 | 5/1990 | Otoshima et al. | 57/268 |
| 5,044,571 | 9/1991 | Ohashi | 242/43.2 X |

FOREIGN PATENT DOCUMENTS

| | | |
|---|---|---|
| 2544652 | 3/1977 | Fed. Rep. of Germany . |
| 2367843 | 5/1978 | France . |
| 2369364 | 5/1978 | France . |
| 2413488 | 7/1979 | France . |

*Primary Examiner*—Daniel P. Stodola
*Assistant Examiner*—William Stryjewski
*Attorney, Agent, or Firm*—Shea & Gould

[57] ABSTRACT

There is described an automatic device for restarting a two-for-one twisting station after yarn interruption, the device being provided on a carriage which patrols the twisting machine faces and is equipped to discharge a completed bobbin, seize the yarn ends from the feed side and the bobbin side and convey them to a joining device, join said ends, pick up a new tube and position it on the bobbin carrier arm, bring the yarn ends on the feed side up to it and restart the station, so restoring the yarn flow.

7 Claims, 10 Drawing Sheets

76
77
18
75
15
19
75C
18
77
80
79
78
75A
75B
16
15

AUTOMATIC DEVICE FOR STARTING A TWO-FOR-ONE TWISTING STATION AFTER INTERRUPTION OF THE FEED YARN AND RELATIVE AUTOMATIC PROCESS

This is a continuation of application Ser. No. 07/520,547, filed May 8, 1990 now abandoned.

BACKGROUND OF THE INVENTION

This invention relates to an automatic device for starting a two-for-one twisting station, in particular after interruption of the feed yarn.

The twisting operation consists of binding together two or more yarns by twisting them together about their longitudinal axis. This operation enables yarns to be obtained which are of greater quality, more resistant to tension and abrasion, more uniform and with a better appearance and feel.

Twisting can be carried out either by feeding the two or more yarns after they have already been combined and wound parallel to each other by a combiner, or by withdrawing the individual yarns from two separate, preferably conical bobbins lying coaxially one above the other.

For a better understanding of the technical problem involved in twisting and their solution by the present invention a description is given hereinafter of a two-for-one twister in terms both of the device itself and the process, with reference to its feed by separate bobbins which each feed single yarns, it being however noted that the technical problem and its solution by the present invention also apply to the case in which the feed is by means of already combined yarns.

BRIEF DESCRIPTION OF THE DRAWINGS

The two-for-one twisting machine consists of a plurality of twisting stations disposed side by side along one or both machine faces. FIG. 1 represent a twisting station, shown in side view in FIG. 1*a* and in front view in FIG. 1*b*.

Figure 1A:
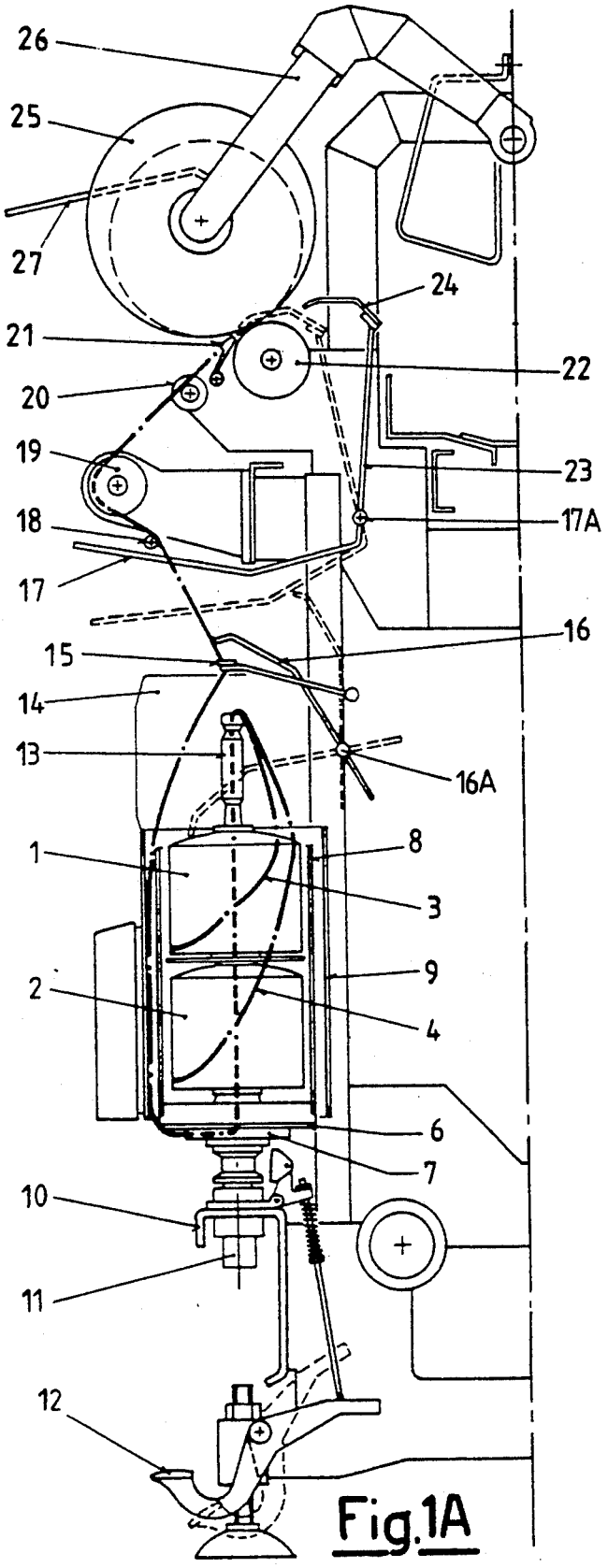
FIG. 1 represents a two-for-one twisting station, shown in side view in FIG. 1*a* and front view in FIG. 1*b*.
Figure 1B:
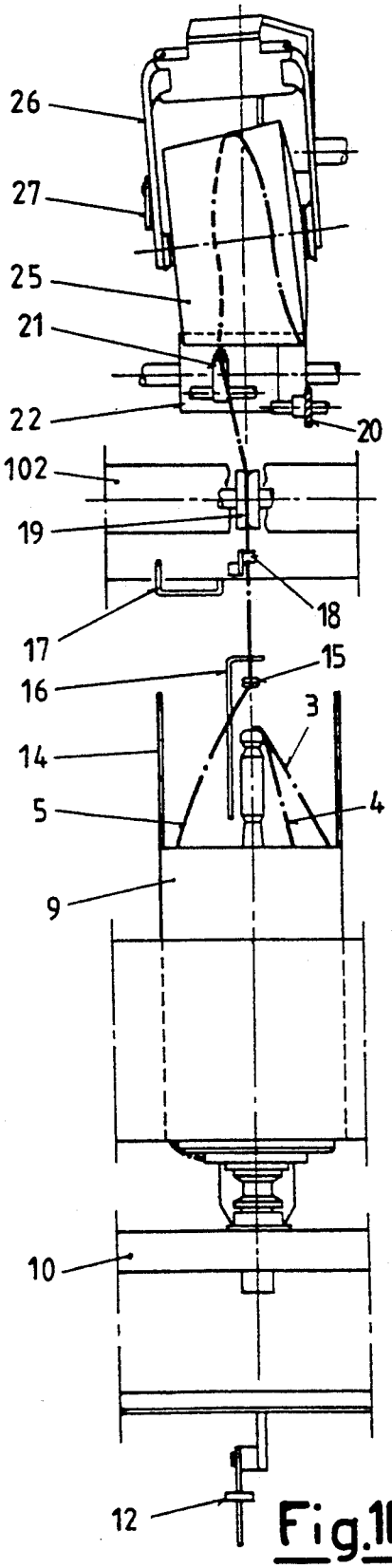

The feed is provided by the upper feed bobbin 1 and lower feed bobbin 2 which feed the single yarns 3 and 4 to form the double twisted yarn 5. The twisting action is performed by the assembly comprising the rotary plate 6 and compensator pulley 7 which are rotated at constant speed by a drive belt, not shown on the figure. The two bobbins 1 and 2 are contained in a basket 8 which is itself contained in a balloon container 9. These parts are fixed, the only moving members in the lower part of the machine being the rotary plate 6, the pulley 7 and their drive. A support bracket 10, known currently as the spindle holder and containing the spindle bottom bush 11, supports said rotating members.

A clutch and brake member, controlled by the pedal 12, connects and disconnects the compensator pulley 7 and rotary plate 6 to and from the belt drive, which engages the underlying race at 7, and is alternately tensioned and slackened on a central drive, not shown on the figure, in the form of long rotating shafts which extend along the entire twisting machine.

The two yarns 3 and 4 are withdrawn from the bobbins 1 and 2 and enter the unwinding head 13 to pass through it from top to bottom along the dashed-line axis and emerge in a central position from the pulley 7, after which they pass to its periphery, stay with it for a short distance and then separate from it by the action of a guide, to then enter the interspace between the basket 8 and container 9.

The yarn passes through this interspace, then through the overlying space bounded by the separators 14, to engage the yarn guide spiral 15.

The yarn is drawn through by the tension exerted by the overlying collection bobbin which is described hereinafter. The relationship which governs the working parameters is $$2N = A.T$$

where N indicates the r.p.m. of the pulley 7, A the yarn speed in meters per minute and T the number of twists per meter. The first twist turn is given to the yarns in the portion between the head 13 and the exit guide for the pulley 7 , the second twist turn being given to the yarns between this exit guide and the yarn guide spiral 15.

The yarn passes upwards after the spiral 15 to encounter the yarn feeler 16 which when in its normal working position keeps the resetting lever 17 of the bobbin raising lever in its waiting position, together with the bobbin raising lever 23 itself and the blade 24, and hence the deviation roller 18 and the yarn dragger 19.

This yarn dragger consists of a pair of rotating discs which face each other to form a tortuous groove in which the twisted yarn engages and is dragged upwards so that the action of the tension is divided between said dragger and the subsequent bobbin, so avoiding concentrating the tension in a single member. In effect, the linear speed of the dragger 19 is slightly greater than the collection speed, but between the yarn 5 and the dragger 19 there is a certain slippage which increases when the tension above 19 slackens.

Proceeding upwards, above the dragger 19 there is the lead screw 20 which guides the yarn when it is required to create a yarn reserve on one end of the tube when a new bobbin is to be wound. It is only on this occasion that the yarn is carried by this lead screw, and disengages by itself after a few turns have been wound on the tube, to re-enter the normal yarn guide 21 which distributes the yarn along the bobbin. The yarn guide 21 slides on a horizontal guide bar with to-and-fro motion. The bobbin is rotated by the roller 22 which rotates at constant speed. Between the bobbin and roller 22 there can be interposed by the action of a bobbin raising lever 23 a raising blade 24 controlled by the resetting lever 17, which constitutes a prolongation of the lever 23, connected to the yarn feeler 16.

The bobbin 25 under formation, which collects the twisted yarn 5, is carried by the bobbin carrier arm 26 consisting of a raisable fork with two jaws which can be opened by the opening lever 27 which when raised in a vertical plane raises the bobbin 25 and which when moved in a horizontal plane opens the fork and forces apart the holding centres which hold the tube on which the bobbin 25 is wound.

As the bobbin 25 receives yarn 5 and winds it by rotating against the roller 22, it increases its diameter with the result that its rotation speed reduces, although the linear winding speed remains constant. As the formation of the bobbin 95 proceeds, its radius increases and the arm 26 rises.

If the yarn 5 is interrupted for any reason, the yarn feeler 16 falls into the position shown by dashed lines, by rotating about the pivot 16A, with the result that by the effect of a lever mechanism not shown in the figure, the lever 17 falls into the position shown by dashed lines by rotating about the pivot 17A. Thus the lever 23 also rotates, to move the blade 24 into an interposed position between the roller 22 and bobbin 25, so raising this latter and halting it.

The interruption of the yarn thus causes the bobbin 25 to halt and rise, and at the same time operate an alarm signal which calls the attention of the operator.

During normal operation the linear rate of deposition onto the bobbin 25 corresponds to the linear rate of withdrawal from the feed bobbins 1 and 2 or to a multiple thereof, so that the absence of the yarn 5 against which the yarn feeler 16 rests indicates either yarn breakage or emptying of the feed bobbins 1 and 2. It is interesting to note than even if only one of the two yarns 3 and 4 from the feed bobbins 1 and 2 undergoes interruption, the yarn 5, which then consists of only the surviving yarn unable to twist about the other missing yarn and thus weakened, is unable to resist the upward pulling tension and breaks.

It should be noted that as the natural twists in the two yarns 3 and 4 are in the opposite direction to the twists deriving from the twisting process, the absence of one of the two yarns causes the surviving yarn to untwist and become reduced to substantially parallel fibres, which result in a yarn of very low consistency. Following the request for attention by the operator by one of the constituent twisting stations of the machine, the operator checks whether stoppage of the station because of absence of yarn at the mechanical yarn feeler 16 is due to emptying of the feed bobbins 1 and 2 or to yarn breakage.

If the first of these two cases applies, the operator raises the yarn feeler 16 into its raised rest position and replaces the two empty bobbins with two new bobbins, he withdraws the yarn ends and inserts them into the axial path, and then he makes them rise up through the interspace to the yarn guide spiral 15, preferably with the aid of pneumatic nozzles or mechanical members. If the second case applies, the operator again raises the yarn feeler 16 and seeks the yarn ends on the feed side of the two bobbins, after which he inserts them into the aforesaid path. The devices and procedure described up to this point form the subject of the preceding Italian patent Nos. 1.097.719, 1.127.088, 1.125.340, 1.125.341 and 1.195.894 in the name of Officine Savio S.p.A., to which reference should be made for further details.

SUMMARY OF THE INVENTION

The object of the present invention is to solve the technical problem of effecting the further operations comprising restoring yarn continuity and restarting the two-for-one twisting station by means of an automatic device, both in the case of empty feed bobbins, in which case the operations correspond to doffing the formed bobbin and replacing it with a tube, and in the case of yarn breakage.

The action required of the operator is merely to take the yarn on the feed side, insert its ends into a gripping member for its consignment to the automatic restarting device, and indicate the type of operation, i.e. doffing or rejoining, which the device is required to effect.

DESCRIPTION OF THE PREFERRED EMBODIMENT

The rejoining and doffing device and procedure according to the invention are described with reference to a typical embodiment illustrated in FIGS. 2 to 10.

Figure 2A:
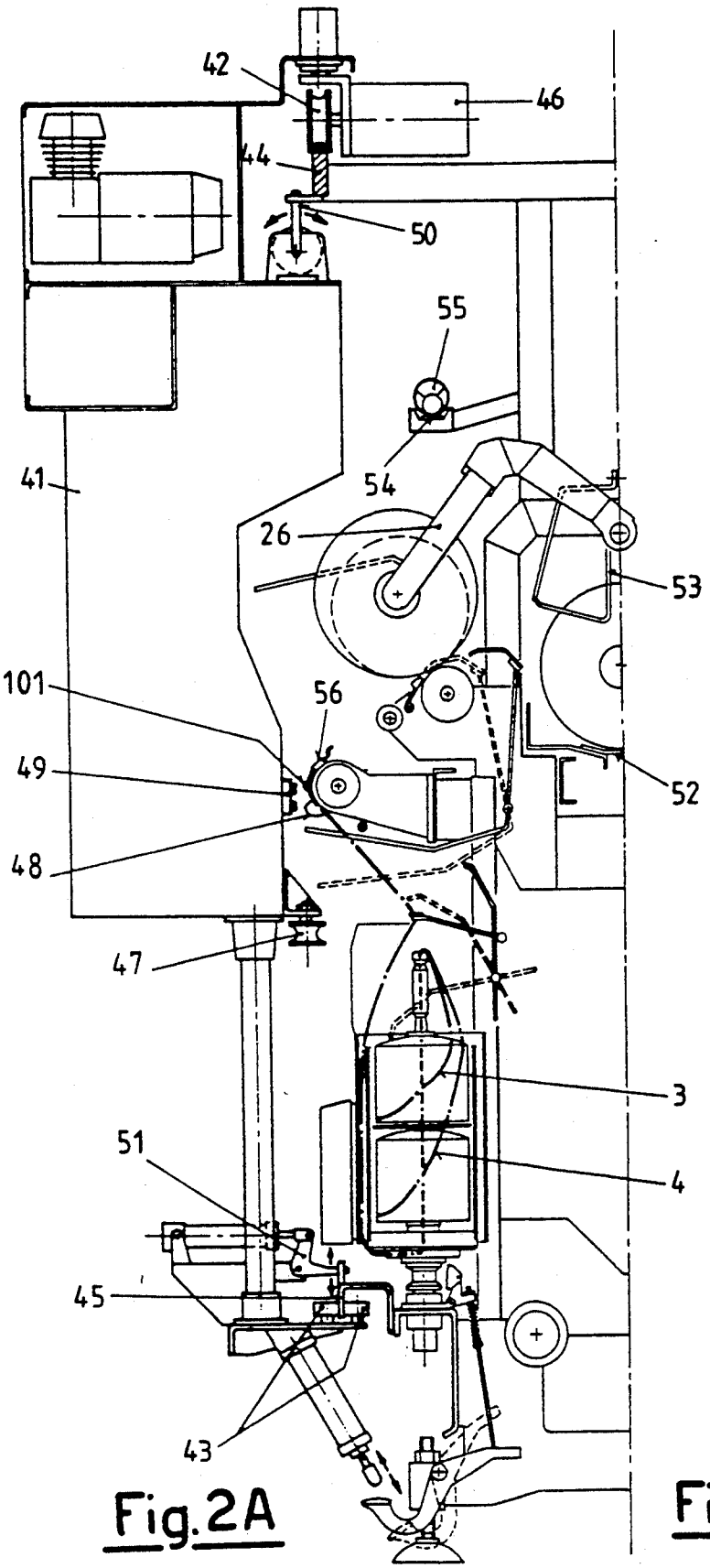
FIG. 2 shows the right-hand side view of the restarting device according to the invention shown, in side view in FIG. 2A and front viewer in FIG. 2B.
Figure 2B:
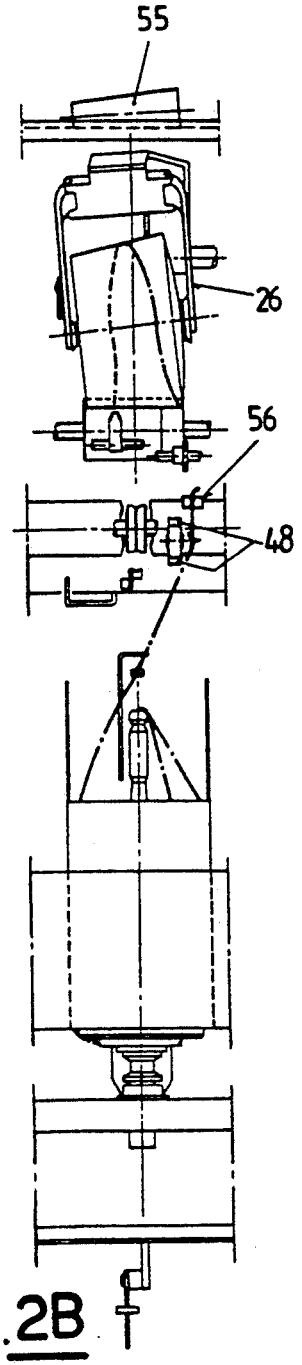

FIG. 2 shows a right hand side view of the restarting device according to the invention. It is contained in a mobile carriage 41 which contains the equipment for automatically carrying out the required operations and which patrols the face or faces of the twisting machine by running with coupled wheels 42 and 43 along the rails 44 and 45, which position it in the vertical plane and horizontal plane. The carriage is driven by a geared motor 46. The carriage 41 patrols the faces of the twisting machine examining the positions of the call signal devices 48.

It can pass from one face of the twisting machine to the other by turning about the end of the machine. The rail 44 turns through a U bend along which the carriage has the support of a further U-shaped guide at half height, not shown in the figures, on which the coupled wheels 47 rest.

According to a preferred embodiment, the rails 45 extending along the two machine faces are not connected by a U bend. This is to allow access to the tail end of the machine for the service trolleys into which the bobbins are unloaded.

The call signal devices 48, positioned at each twisting station, are of known type and are capable of providing three different indications, which are originated by the operator after he has checked the type of action required and has accommodated the yarn on the feed side as already described:

the first indicates an action requirement for a restart involving the doffing cycle;

the second indicates an action requirement for a restart involving the rejoining cycle;

the third, which is in fact a non-indication, is represented by the absence of signal generation and allows the carriage to pass by, either because the station is working normally or because it is not set up for restart, or because it is out of service. Sensors 49 of known type are positioned on both the lateral faces of the carriage 41 to receive the signals emitted by the call signal devices 48.

When the sensors 49 receive signals requesting one of the two scheduled types of action, the automatic carriage 41 firstly slows down by operating the low speed geared motor 46, and when in proximity to the centre of the station it receives a signal which halts the motor and operates the locking blocks 50 and 51 which engage in two V-shaped cavities at the halt point, so ensuring correct positioning of the carriage 41 and its equipment relative to the twisting station.

The twisting machine is provided with a conveyor belt 52 for unloading the bobbins produced. It is located in the central part of the twisting machine and extends along its entire length as far as the discharge end, i.e. its rear end.

Between one station and the next and along the path of the belt 52 there are provided separators 53 which prevent the discharged bobbins from trespassing on the space corresponding to the adjacent stations. After a predetermined number of bobbins have been discharged onto the belt 52 the separators 53 are raised, the belt 52 is driven and the bobbins lying on it are moved to the tail end of the twisting machine where a trolley bin collects them for despatch to subsequent operations.

Above the bobbin carrier arm 26 there is a small conveyor belt 54 for carrying the new tubes 55, which are placed longitudinally on it. Said conveyor belt feeds the service carriage 41 with the new tubes 55 which have gradually to be positioned on the bobbin carrier arms 26, and specifically between the holding centres, so that new bobbins of twisted yarn can be formed on them.

As required by either action cycle, the ends of the two feed yarns 3 and 4 from the bobbins 1 and 2 will have already been positioned by the operator in the retention member 56, from which the equipment on the carriage 41 withdraws them.

The doffing equipment and process will new be described with reference to FIGS. 3 to 6.

Figures 3A, 3B, 3C:
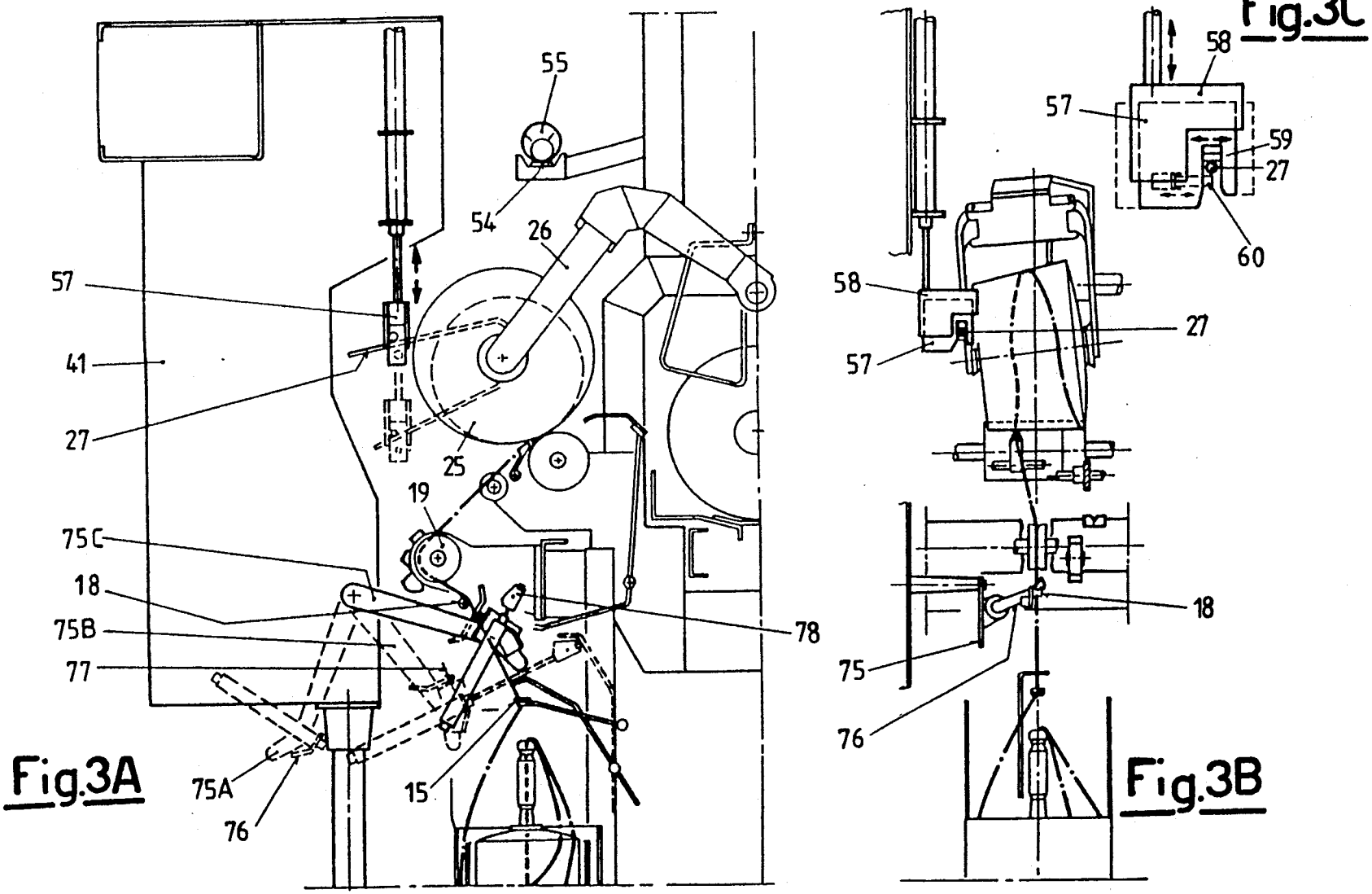
FIG. 3A shows a fight hand side view of the service carriage.
FIG. 3B shows a front view of the service carriage shown in FIG. 3A.
FIG. 3C shows a detailed view of the main jaw illustrated in FIG. 3B.
Figures 4A, 4B:
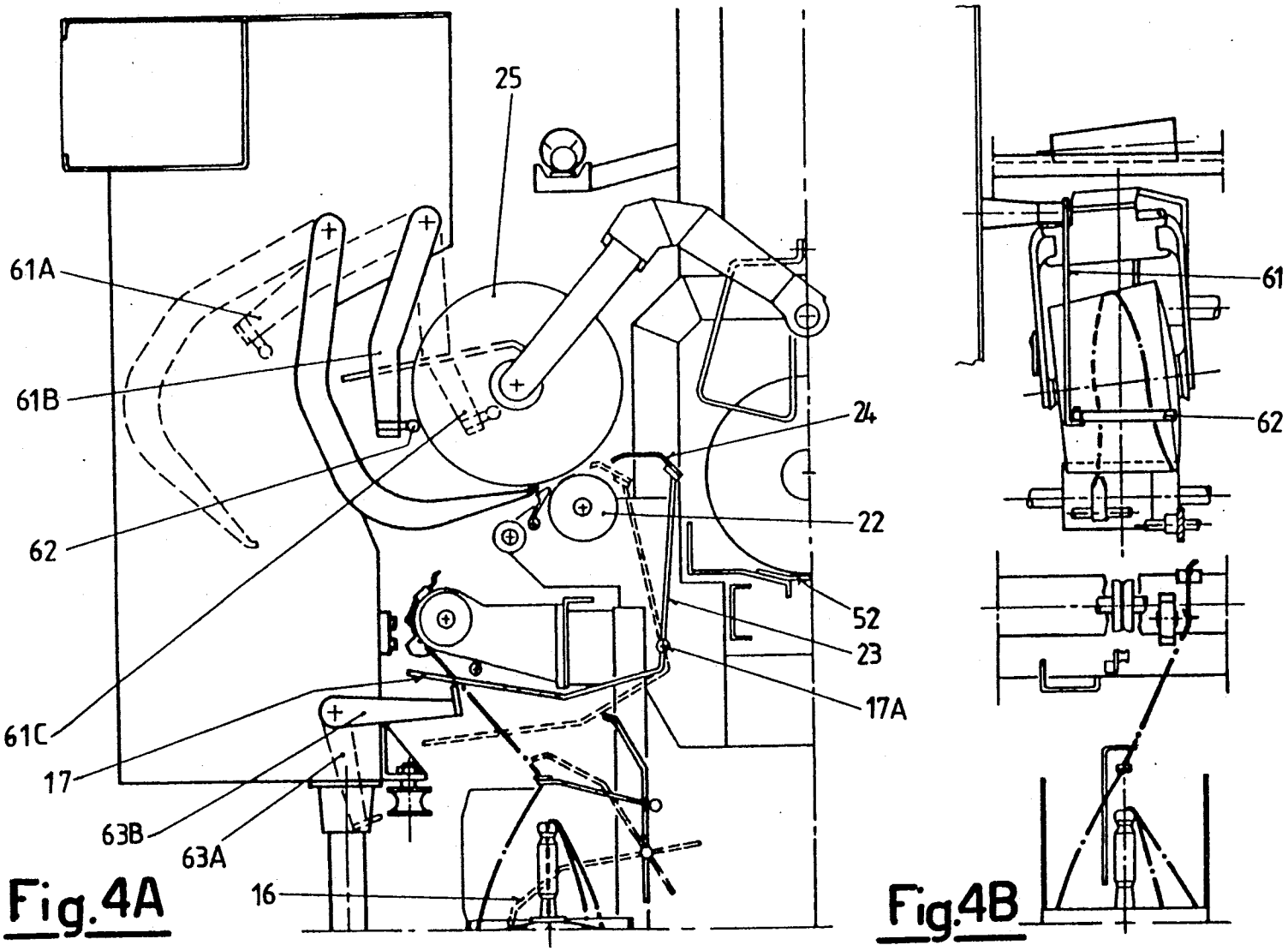
FIG. 4A shows a right hand side view of the service carriage of the present invention.
FIG. 4B shows a front view of the service carriage shown in 4A.
Figure 5B:
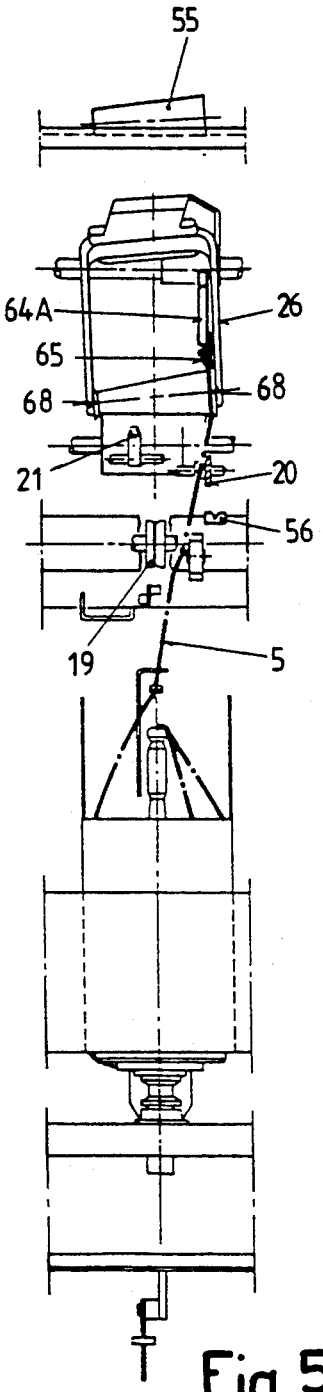
FIG. 5B shows a front view of the service carriage illustrated in FIG. 5A.
Figure 5A:
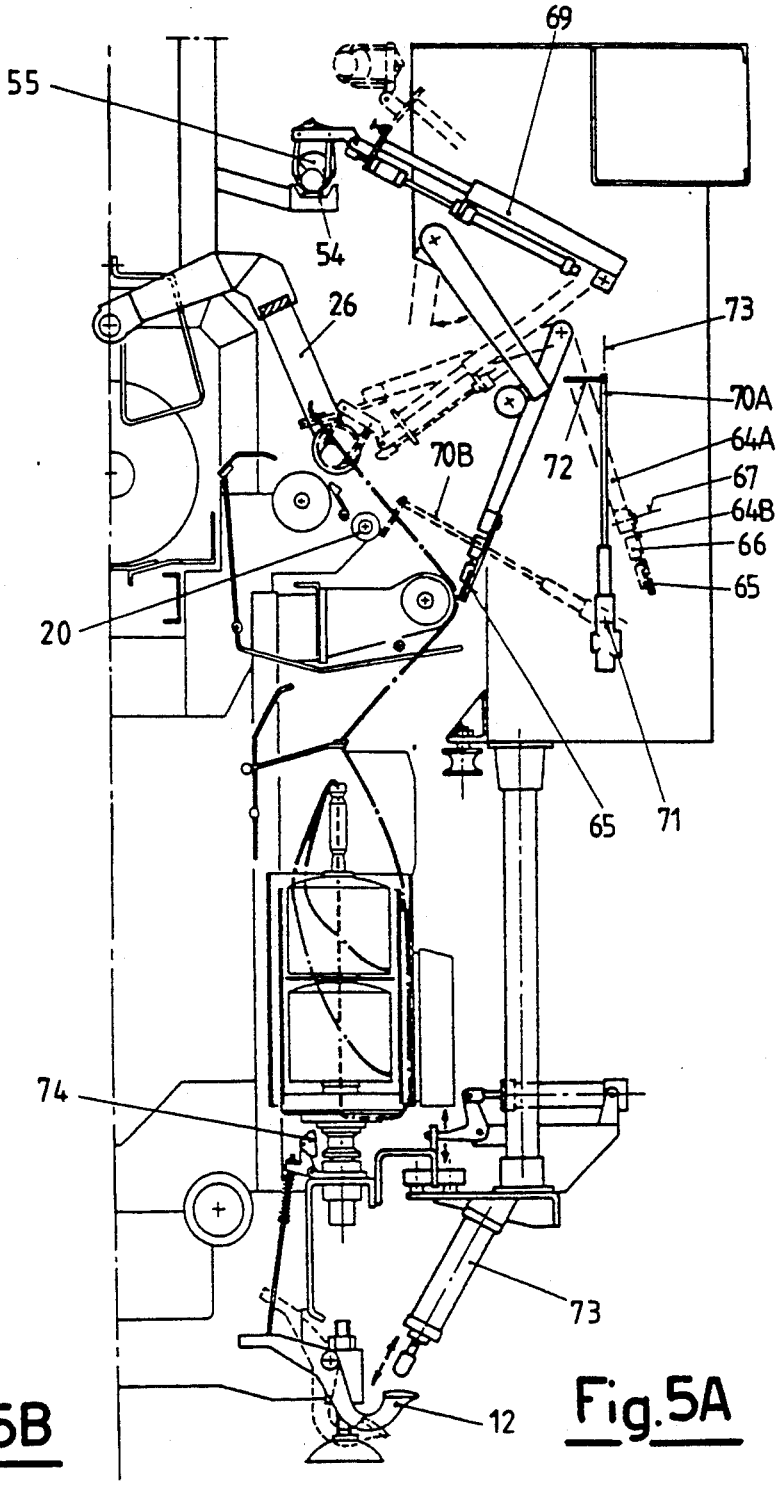
FIG. 5A shows a left hand side view of an embodiment of the service carriage of the present invention.

FIGS. 3, 4 and 6 show the carriage equipment from the right hand side, whereas FIG. 5 is a view of the carriage from the left hand side.

a) Doffing Cycle

The carriage 41 has received the request to stop and effect the doffing cycle by virtue of the signal device 48 having transmitted said request to the sensors 49. It assumes the already described position and executes the doffing cycle consisting of unloading the completed bobbin, replacing it with a new tube, offering the yarn up to it and then restarting the twisting station, in accordance with the following sequence:

a1) The carriage 41 is provided with a photoelectric cell sensor of known type to determine whether the position on the conveyor belt 52 in front of the twisting station is free or is already occupied by an unloaded bobbin. If this position is already occupied, the carriage is released to continue its patrolling travel. In this case the required operation will be carried out during a subsequent passage when the position is found to be free. The twisting station thus remains inactive. If however the position is free of bobbins the cycle begins.

a2) A new tube 55 is brought onto the conveyor belt 54 from the tube store which is located at the front end of the twisting machine but is not shown on the figure. A wall, not shown on the figure, is lowered by the carriage 41 to halt the tube at the twisting station on which the operation is taking place, in the correct position to allow its picking up by the equipment described hereinafter. In a preferred embodiment, said wall is provided with a sensor which senses the arrival of the tube 55 and halts the movement of the belt 54.

In a further embodiment, the wall always remains lowered in a position in which it blocks the arriving tube 55, for the time that the carriage 41 moves along the same front.

Only when it turns around the tail end of the machine is said wall lifted (as it can no longer retain the tube in the correct position) and a further wall which operates in exactly the same manner as the first is lowered.

a3) A gripper arm 57 is lowered by the carriage 41 and engages the lever 27. The arm 57 then rises in a vertical plane and lifts the lever 27 and the bobbin carrier arm 26 with the finished bobbin 25 through a small distance.

The gripper member on the arm 57 consists of a main jaw 58, its insert 59 and a bar 60 which moves orthogonally to the arm 57. On lowering the arm 57, the slot in the insert 59 engages the lever 27 and the bar 60 locks it by extending.

The bobbin carrier arm is raised and lowered by the movement of the arm 57. By its movement relative to the jaw 58, the insert 59 moves the lever 27 in a horizontal plane and is able to open the bobbin carrier arm 26 by moving its holding centres apart.

a4) An L-shaped expulsion lever 61 is moved up to the bobbin 25 by the carriage 41, by rotating about a horizontal axis from a rest position 61A to a position 61B in which the terminal part of the L bears against the bobbin 25 along a generator. The terminal part of the L is preferably provided with an idle roller 62.

a5) By the movement of the insert 59 relative to 58 the holding centres on the bobbin carrier arm 26 are moved apart and the lever 61 is brought into its end position 61C, so causing the bobbin to overcome the blade 24 and fall onto the conveyor belt 52.

a6) The blade 24 is removed and returned to its waiting position. The blade 24 is reset in its waiting position by rotating the lever 17 and its prolongation 23 about the pivot 17A by means of a rotary arm 63 which rises from a rest position 63A to a setting position 63B. The blade 24 and its lever 23 are retained in the waiting position by a mechanical hook, not shown in the figure, which is disengaged by the yarn feeler 16 when it falls due to absence of yarn.

After the blade 24 has been reset, the arm 63 returns to its rest position 63A.

The expulsion lever 61 returns to its rest position 61A.

a7) The bobbin carrier arm 26, still with its holding centres open, is lowered by the arm 57 into the proximity of the roller 22, until it contacts a stop which has been preset according to the shape of the tube 55.

a8) With reference to FIG. 5, the extendable arm 64, provided at its end with a gripper member 65 operated by a servo control 66, for example pneumatic, takes the end of the yarn 5 from the retention member 56.

The yarn 5 still consists in fact of the yarns 3 and 4 not twisted about each other. They will produce the twisted yarn 5 when twisting recommences, by the effect of the twists during restarting which travel upwards.

In the illustrated embodiment, the arm 64 is divided, by way of non-limiting example, into two hinged-together parts 64A and 64B, the part 64B of which can assume two positions, namely extended as a straight prolongation of 64A or folded at a right angle about the axis 67 orthogonally to the plane of FIG. 5, such that its overall length is reduced in order to avoid the obstacles along its path. After gripping the yarn 5 in the position shown by dashed lines in FIG. 4, the arm 64 folds as described and rotates clockwise into the raised position to then re-extend to present the yarn 5 between the open holding centres 68 and in proximity to one of the two, so as to interfere with the next insertion of a tube and be trapped by it.

a9) A feed and positioning device 69 for the new tube, this device already being loaded with a tube and kept in its rest position, brings the new tube to the bobbin carrier arm. The device 69 forms the subject of the copending U.S. patent application No. 509,576.

From its rest position the gripper device 69 rotates downwards and extends to present the new tube aligned with the open holding. centres 68, between which there is also the yarn 5.

a1O) The bobbin raising arm 57 moves its insert 59 horizontally, so moving the lever 27, and closes the holding centres 68 onto the tube presented by the device 69. One of the bases of the locked tube traps the yarn between it and the holding centre. The device 69 releases the tube and retracts into its rest position.

a11) By opening the gripper 65 the arm 64 releases the yarn 5, now locked by the tube, and retracts into its rest position.

a12) The yarn deviator lever 70A,which can rotate about the pivot 71 and is provided with a finger 72 able to rotate about the axis 73, is lowered into the position 70B shown by dashed lines and then rotates the finger 72 anticlockwise to move the yarn 5 to the right of the reserve-forming lead screw 20 which rotates at low speed in the same direction as the drive roller, to carry the yarn 5 ready to wind on the right hand end of the tube lying between the holding centres 68.

a13) The carriage 41 lowers the pneumatic piston 73 so that it pushes the pedal 12 which releases the brake 74 to cause the plate 6/pulley 7 assembly to rotate and begin to apply twist to the yarn 5, which up to now still consisted of the parallel yarns 3 and 4 travelling upwards. The sequence proceeds by lowering the arm 57 which by means of the lever 27 returns the bobbin carrier arm 26 towards the roller 22 so that the tube is rested against it. The tube begins to rotate with the result that the yarn reserve consisting indicatively of a length of yarn of the order of some meters is wound on its right hand end.

Figures 6A, 6B:
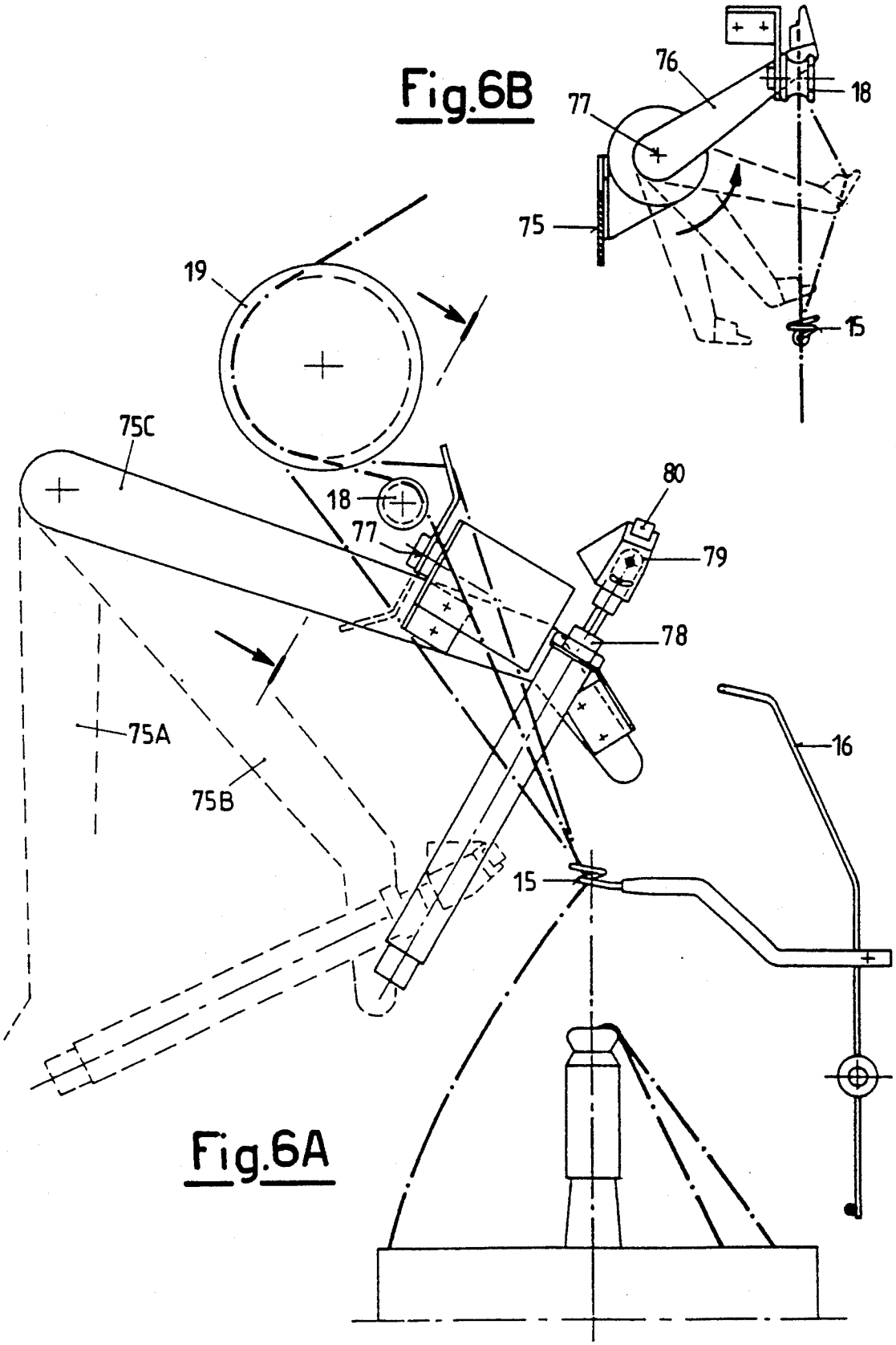
FIG. 6A shows a fight hand side view of the service carriage of an embodiment of the present invention.
FIG. 6B shows a detail of the finger shown in FIG. 6A.

On commencement of rotation of the tube, the yarn 5 tends to engage in the helical toothing of the lead screw 20. The finger 72 returns to its rest position by clockwise rotation and the deviator lever 70A returns to its initial rest position. The arm 57 disengages from the bobbin raising lever 27 and returns to its rest position.

a14) The lead screw 20, which continues to slowly rotate, releases the tensioned yarn 5 after about 40° of rotation, and escapes towards the centre of the twisting station to engage in the yarn guide 21, with the result that the true winding of the bobbin commences. For the same reason the yarn newly enters the dragging slot 19.

a15) The device 75, the construction and operation of which are best apparent from FIGS. 6A and 6B, is then rotated. The device 75 becomes positioned in proximity to the path of the yarn 5 (position 75C) and operates a hooked finger 76 which is rotated about the axis of the bush 77 by a pneumatic or mechanical drive, not shown in the figure for simplicity, which engages the yarn 5 and carries it into the position shown by dashed and dotted lines at the deviation roller 18 between the spiral 15 and the dragger groove 19 to obtain greater winding in the groove and an improved dragging effect.

After positioning the yarn 5 about the roller 18 the device 75 is lowered into the position 75B to carry out a further operation. On the end of the device 75 there is located an extendable implement 78 for resetting the yarn feeler 16 which returns it into its working position. This forms the subject of the copending U.S. patent application Ser. No. 509,577. Said implement 78 extends its extendable part, comprising a terminal part 79 carrying a magnet 80, until this latter makes contact with the rod of the yarn feeler 16 and then retracts it. As it retracts, the extendable part carries with it the rod 16, which moves by rotating about its pivot so that the magnet 80 gradually separates from the rod of the yarn feeler 16, which continues to rotate while simply resting on the upper face of the terminal part 79 of the implement 78, until it bears against the yarn 5.

When the yarn feeler 16 bears against the yarn 5, the device 75 is returned to its rest position 75A.

a16) The tube positioning device 69, which is empty because it has placed its tube between the holding centres of the bobbin carrier arm 26, now picks up the tube 55 lying on the belt 54. The device 69 forms the subject of the copending U.S. patent application Ser. No. 509,576.

The new tube is used for the next doffing cycle. After its reloading with the new tube 55 the device 69 retracts into its rest position.

Loading the new tube 55 onto the device 69 in the doffing cycle preceding that in which the new tube is used constitutes an improved embodiment of the invention in that it results in a saving in the overall time of the restarting process, and an increase in yield.

It is however possible to provide for the device 69 to be loaded with the tube 55 during the same doffing cycle before positioning it on the bobbin carrier arm 26, and for the carriage 41 to patrol with the device 69 not loaded with the tube.

a18) The carriage 41 is provided with a clearing member, not shown on the figure, for clearing the call signal and resetting the signal device 48 to its normal working position, i.e. in which it no longer emits the call signal.

After it has cleared the signal device the carriage can recommence its patrolling action.

a19) The carriage 41 releases the locking blocks 50 and 51 from the V recesses and recommences its travel by restarting the geared motor 46.

The rejoining equipment and procedure will now be described with reference to FIGS. 7 to 9.

b) Rejoining Cycle

The carriage 41 receives the request to halt and execute the rejoining cycle as a result of the signal device 48 having transmitted this request to the sensors 49.

Figure 7A:
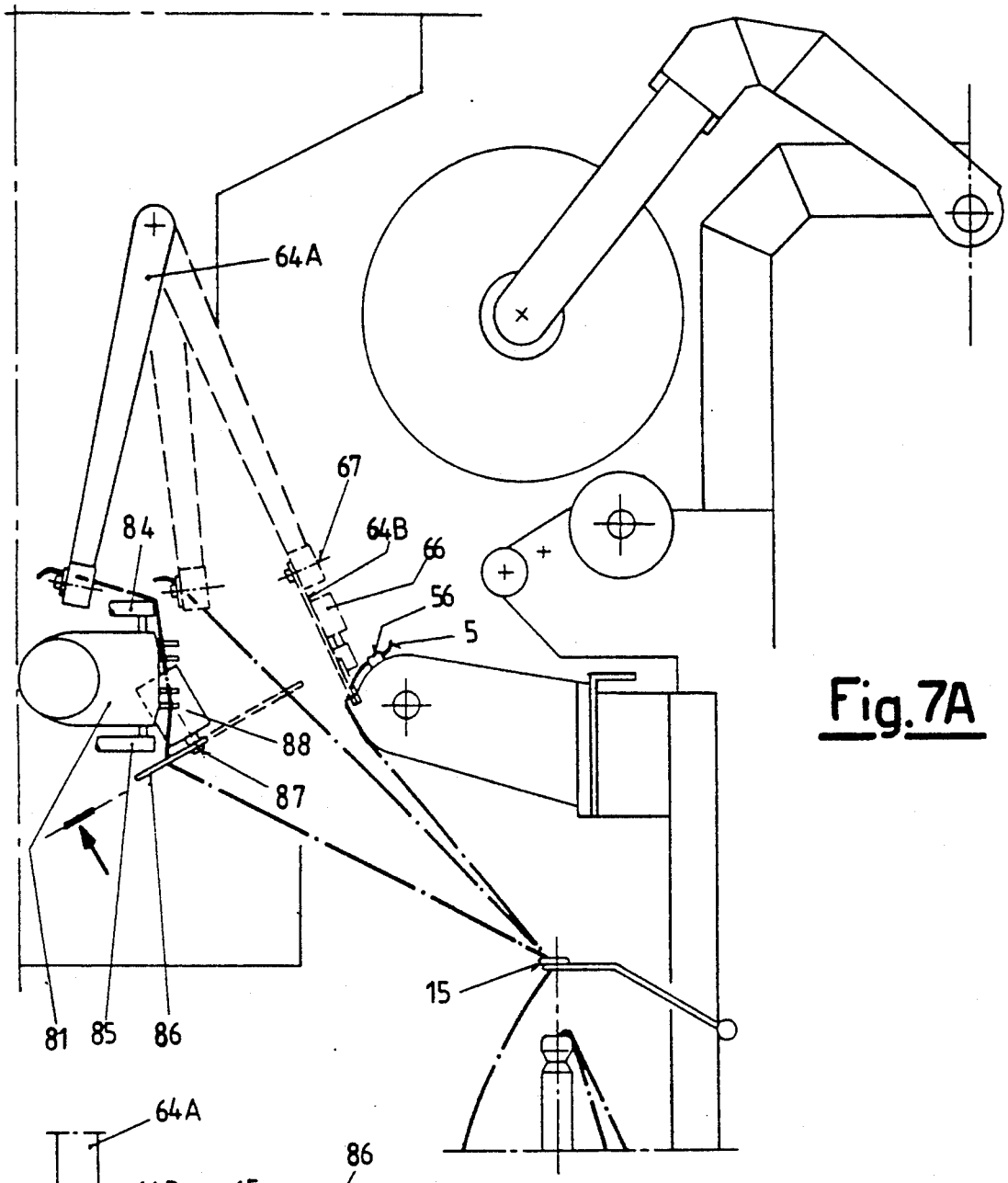
FIG. 7A shows a side view of the service carriage of the present invention performing a rejoining cycle.

It positions itself as described in the introduction and then carries out the rejoining cycle, which consists of seeking the yarn end on the bobbin side, picking up the yarn end from the feed side, feeding the two ends to a knotter, joining them, releasing the joined yarn and restarting the twisting station, in accordance with the sequence described below.

b1) The bobbin 25 is lifted from the roller 22 and interposed blade 24 as described under point a3 of the doffing cycle.

b2) The spacer blade 24 is returned to its waiting position as described under point a6 of the doffing cycle.

b3) The member 64 provided with the gripper 65 proceeds to pick up the yarn end on the feed side, which has been positioned in the presentation member 56, by the following sequence illustrated in FIGS. 7A, B and C.

The arm 64, with its two parts 64A and 64B in their extended configuration, rotates anticlockwise from its retracted rest position and picks up the end of the yarn 5, as described under point a8, in the advanced position.

The end 64B folds through a right angle and the arm 64A then rotates clockwise into the position illustrated by full lines in FIG. 7A. In this manner the yarn is carried to the knotter 81, which comprises two insertion lead-ins, namely 82 for the yarn end on the feed side and 83 for the yarn end on the bobbin side, and two suction ports, namely 84 for the yarn end on the feed side and 85 for the yarn end on the bobbin side.

Figure 7B:
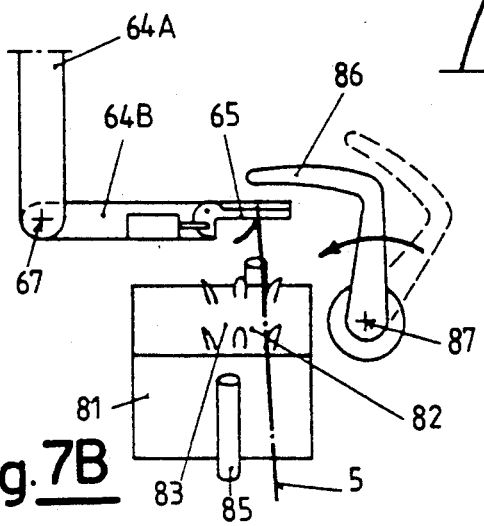
FIG. 7B shows a detail of a front view of the service carriage shown in FIG. 7A.
Figure 7C:
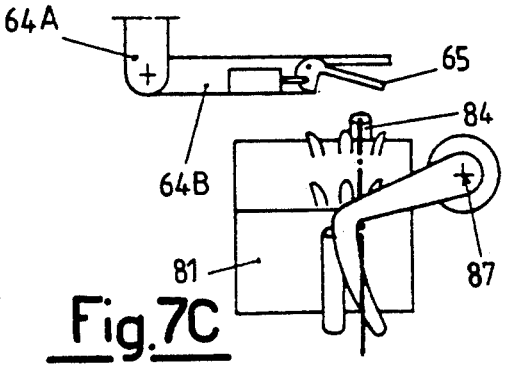
FIG. 7C shows a front view as shown in FIG. 7B with the cycle-shaped member hooking the yarn.

The gripper 65 has now carried the end of the yarn 5 into proximity to the suction port 84. The yarn 5 is already very close to the upper insertion elements which form the lead-in 82 of the yarn joiner 81 for the feed side yarn end, FIGS. 7B and 7C are views of the yarn joiner 81 from below in the direction of the arrow.

b4) The sickle-shaped inserter 86, which is rotated about the pivot 87 by a pneumatic or mechanical drive 88, moves anticlockwise in FIG. 7B from a rest position (shown by dashed lines) to engage the yarn 5 and insert it between the lower insertion elements which form the lead-in 82 of the yarn joiner 81. The required length of yarn 5 is drawn from below from the feed side.

The gripper 65 can now release the end of the yarn 5, which is sucked by the port 84. The yarn also enters the upper introduction elements of the lead-in 82. The yarn from the feed side is now correctly positioned in the knotter 81 and is ready to be joined. Alternatively, the yarn drawn by the sickle-shaped member 86 can be yielded up by the port 84, after the gripper has released the yarn 5.

Figure 8A:
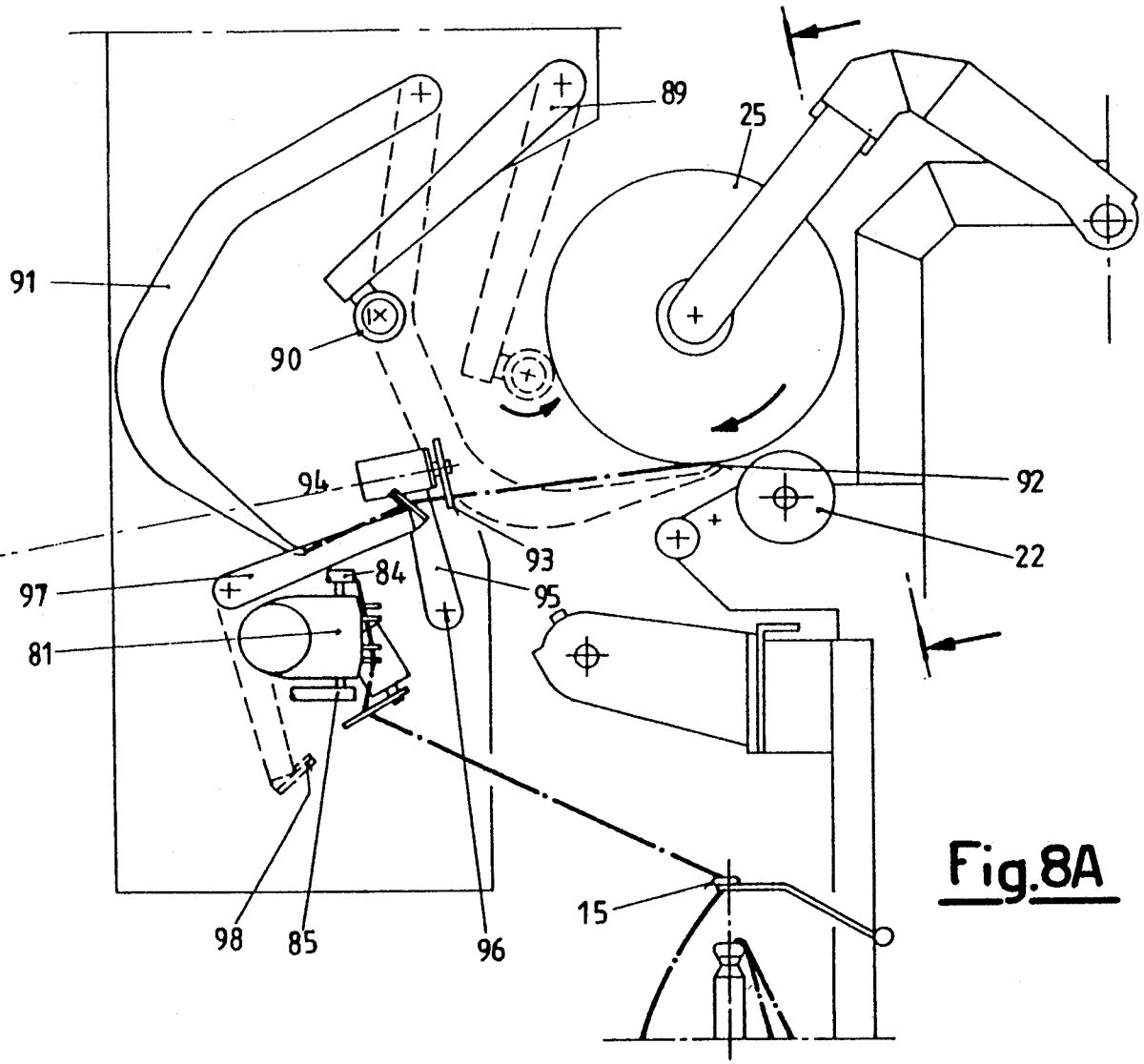
FIG. 8A shows a fight hand side view of the service carriage of an embodiment of the present invention.

The arm 64 can return to its rest position.

b5) The yarn end on the side in the direction of the bobbin 25 is picked up by the following sequence, which is illustrated in FIGS. 8 and 9. A rotary arm 89 provided with a motorized unwinding roller 90 is brought up to the bobbin 25 in the position shown by dashed lines so as to rest the roller 90 on the bobbin, and the roller is then rotated thus rotating the bobbin 25 in the direction of the rotation arrows in FIG. 8A.

The suction port 91 provided with a slot-type suction nozzle 92 is rotated anticlockwise into the position shown by dashed lines in which it is adjacent to a generator of the bobbin 25.

The suction port sucks in the yarn end of the bobbin 25 by moving forward and withdrawing one or more times to facilitate pick-up of the yarn end and overcome any resistance should the yarn have wound irregularly after its interruption.

The port 91 then withdraws with clockwise rotation into the position shown by full lines in FIG. 8A, taking the yarn with it, while the roller continues to unwind the yarn, to be conveyed along by the suction port.

Figure 8B:
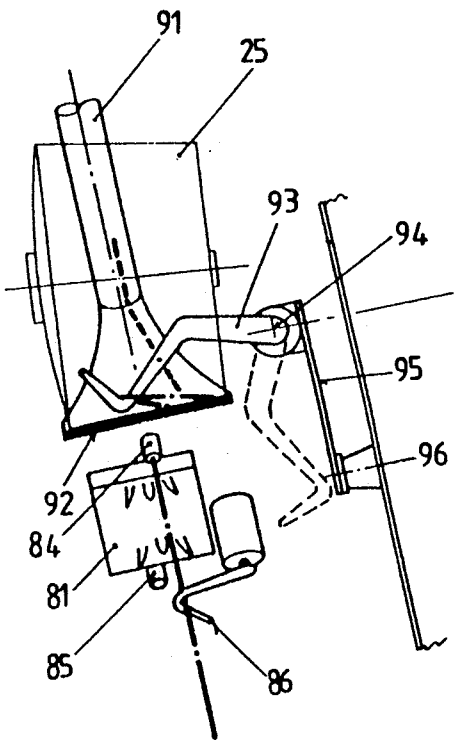
FIG. 8B shows a front view of the suction port and the cycle-shaped member shown in FIG. 8A.

The unwinding roller 90 is halted, the yarn on the bobbin side being in any position of the slot of the suction nozzle 92.

b6) A sickle-shaped lever 93, rotatable about the axis 94 on a further orthogonal lever 95 which rotates about an axis 96 orthogonal to the axis 94, inserts the yarn into the lead-in 83. FIG. 8B is a view of the yarn joiner 81 taken on the arrow of FIG. 8A.

Figures 9A, 9B, 9C:
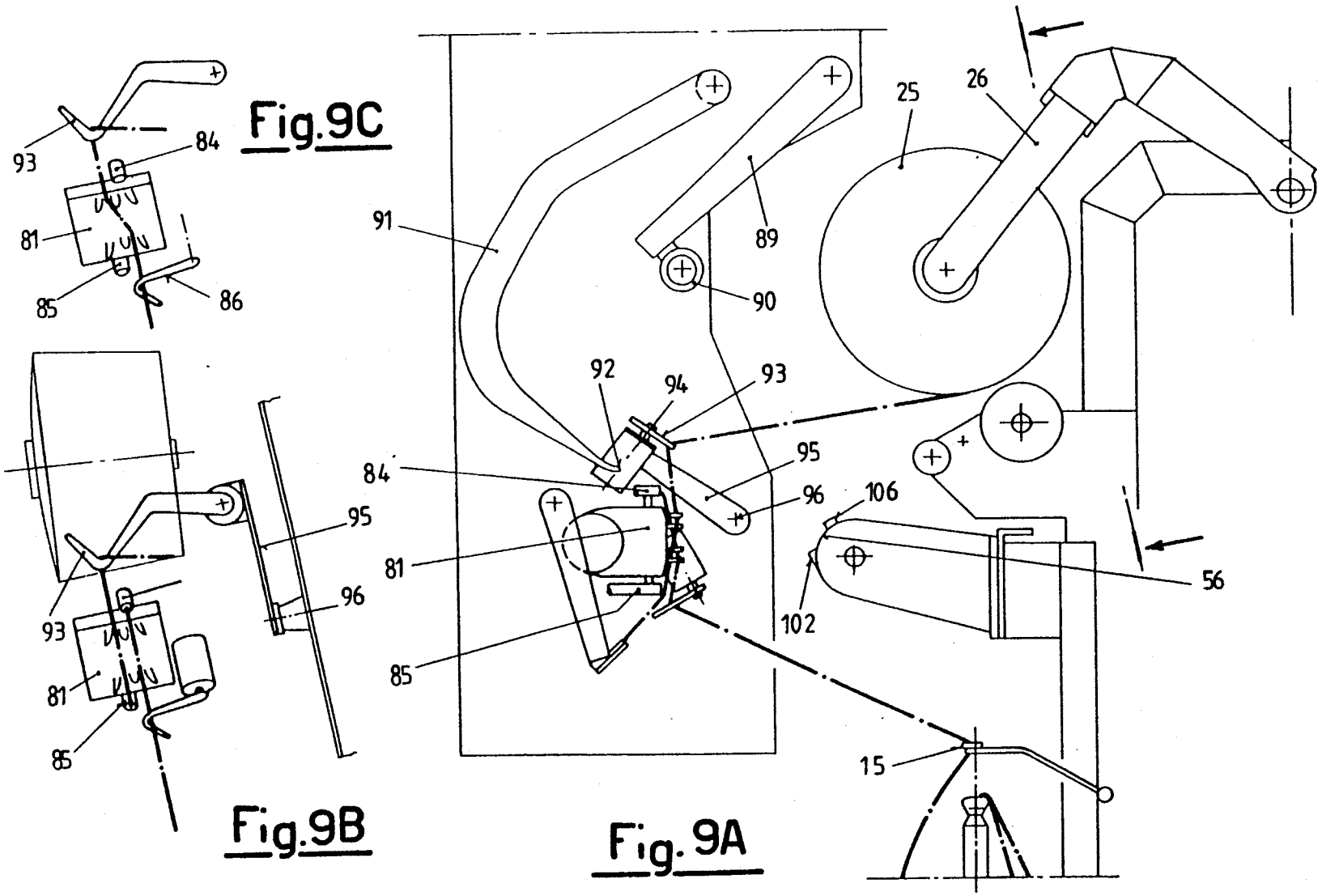
FIG. 9A shows a fight hand side view of an embodiment of the service carriage of the present invention.
FIG. 9B shows a front view of the embodiment shown in FIG. 9A.
FIG. 9C shows the cycle-shaped member hooking the yarn shown in FIG. 9B.

The sickle-shaped lever 93 firstly rotates from its dashed-line rest position of FIG. 8B upwards to its full-line position and centres the yarn by moving it into the cavity of the sickle. An arm 97 provided with a gripper 98 and scissors rotates upwards anticlockwise from the dashed-line position to the full-line position downstream of the sickle-shaped lever 93 in FIG. 8A, to grip the yarn with the gripper 98, the scissors then cutting off its tail, which is sucked in by the port 91. The arm 97 rotates clockwise into the dashed-line position so that the gripper 98 takes the yarn end on the bobbin side and engages it in the lower introduction elements of the lead-in 83. Simultaneously, the roller 90 again rotates to transfer yarn to the arm 97. When the arm 97 has reached its rest position (shown by dashed lines) the roller 90 stops and the arm 89 returns to its rest position.

b7) The completion of the insertion of the yarn end on the bobbin side is shown in FIGS. 9A and 9B. FIGS. 9B and 9C are views on the arrows of FIG. 9A.

The sickle-shaped lever 93 is raised together with the yarn lying in its recess, which extends as far as the gripper 98 in the dashed-line position of FIG. 8A.

The lever 95 is rotated anticlockwise about the axis 96, so that the sickle-shaped lever 93 withdraws to cause the yarn to also penetrate into the upper introduction elements of the lead-in 83. The gripper 98 abandons the yarn end, which is drawn in by the port 85.

The yarn from the bobbin side is now correctly positioned in the knotter 81 and is ready to be joined, in the configuration of FIG. 9B.

b8) The yarn joiner 81 is of the conventional type known in the art. It can consist of a mechanical knotter which executes a fisherman's or weaver's knot, or a compressed air pneumatic knotter.

The joint is then made. With the making of the joint the two yarn ends on the bobbin side and feed side are now joined together and are in the configuration shown in FIG. 9C.

The continuity of the yarn has now been restored and this is retained in position by the sickle-shaped levers 86 and 93. The two tails have been cut off and are sucked in by the ports 84 and 85.

b9) On the basis of a time program the twisting station is restarted in sequence at predetermined time intervals by starting the plate 6/pulley 7 by operating the pneumatic piston 73, as described under point a13.

By rotating, the pulley 7 twists the yarn and slightly draws it from above to form the balloon; the sickle-shaped members 86 and 93 are still in their position for inserting the yarn ends into the lead-ins of the yarn joiner 81, and are reopened slowly, first the lower and then the upper, to gradually release the yarn.

The bobbin 25 is simultaneously made to restart, by resting on the roller 22 as a result of the bobbin carrier arm 26 being moved by the lever 27 which is still engaged by the arm 57. After returning the bobbin 25 into contact with the roller 22, the arm 57 can release the lever 27 and retract into its rest position.

b10) The yarn 5 is again passed about the roller 18 and the yarn feeler 16 is reset, as described under point a15.

b11) The carriage 41 clears the signal emitted by the call signal device as described under point a18.

b12) The carriage returns to patrolling the twisting machine as described under point a19.

Figure 10:
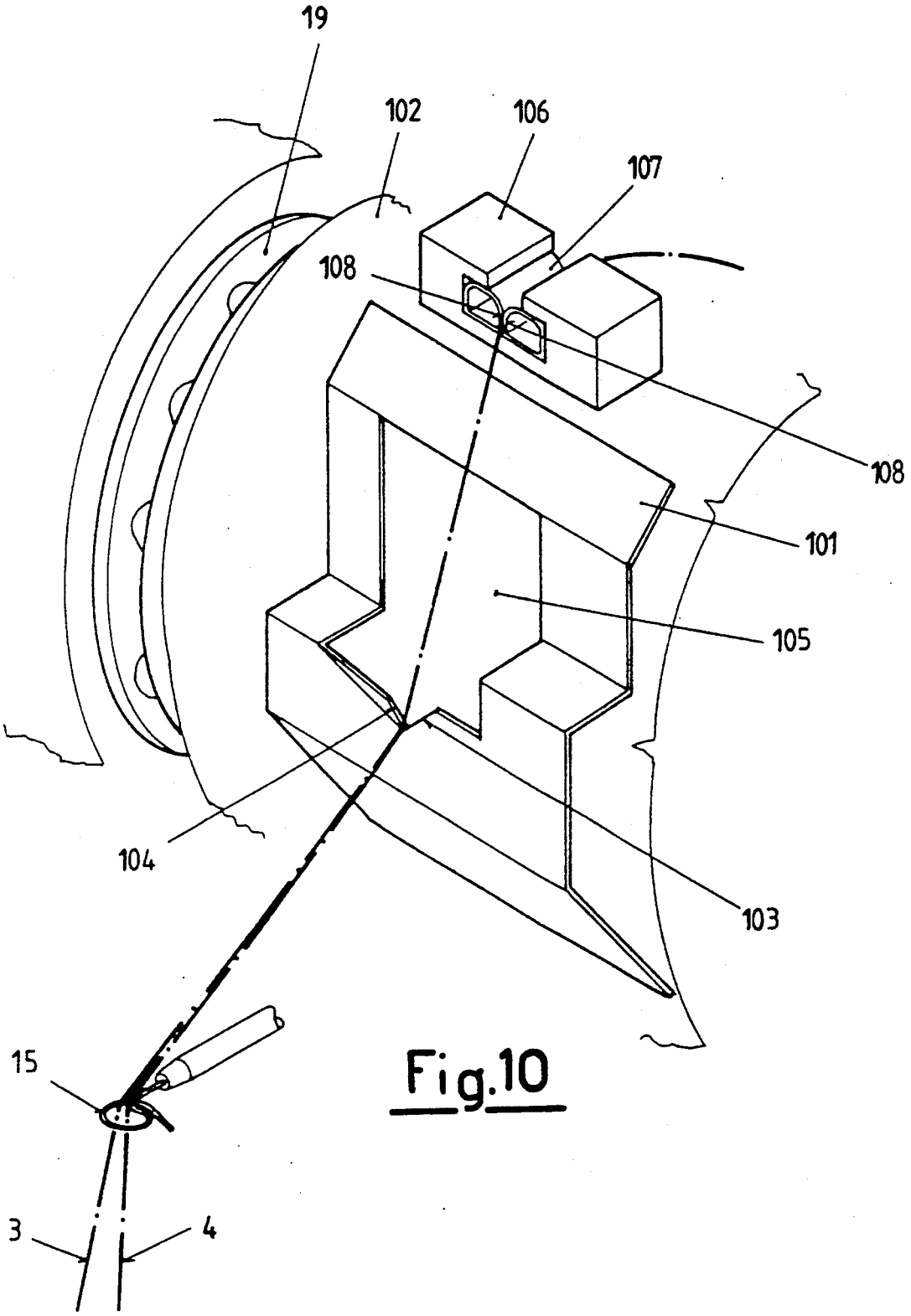
FIG. 10 shows a detailed view of an embodiment of the retention and delivery member of the present invention.

The member 56 for retaining the yarn end on the feed side is shown in FIG. 10. It consists of a gripper and a centering V for the inserted yarn located in the guard plate to the side of the draggers 19, it being shown in FIG. 10 by way of example on the right hand side.

It consists specifically of a shaped plate 101 fixed onto the dragger guard plate 102 and shaped with a centering V 103 for the yarns 3 and 4 from the feed side. The side 104 of the V which extends towards the centre of the twisting station is more outwardly advanced to oppose the natural tendency of the yarn to move to the left.

In its centre the plate 101 has an aperture 105 of such shape and dimensions as to give easy access to the gripper 65 for seizing the yarn end.

Above 101 and coaxial to the centering V 103 there is a block 106 which contains an insert 107 of harmonic steel shaped in the form of a B lying on its side and acting as a gripper. The two ends of the lead screw of the B are yieldable, to allow the yarn to be easily inserted therebetween and retained.

To position the yarn the operator passes the ends of the yarns 3 and 4 through the centering V 103 and forces them into the insert 107, then tearing off their tails by pulling laterally. The gripper 65 picks up the yarn along its free portion between 103 and 107, which lies within the aperture 105, and thus in a constant position.

The grip exerted between the two ends 108 is delicate so that the gripping force of the gripper 65 prevails over it and this latter can withdraw the yarn for the operations involved in restoring the continuity of the yarn between the feed and the bobbin.

According to a preferred embodiment, the carriage 41 is provided not only with the equipment heretofore described but also with control members and auxiliary services which make it self-sufficient.

The described operations are controlled by a programmable logic controller, i.e. a PLC, which controls the required operation sequences by feeding signals for implementing the described movements and for controlling the auxiliary services. Electric power is supplied to the carriage 41 by a multi-contact bus duct, preferably with 7 contacts, which also serves for transmitting signals. For example it transmits the signals to the tube store for depositing a new tube 55 on the conveyor belt 54 and for its movement towards the twisting station on which the doffing cycle is to be carried out, and for stopping the belt when the new tube has arrived. It also transmits the signal to the bobbin unloading belt 52 to cause it to start and undergo an unloading path of at least one half of a revolution, corresponding to the machine length, and to raise the separating baffles 53 when the PLC has calculated a predetermined total number of doffing cycles and the trolley bin is in the position for receiving the bobbins.

In addition to the described equipment and the PLC, the carriage 41 also contains a system for producing compressed air by a reciprocating compressor for operating the pneumatically operated equipment, and a vacuum production system comprising an electrically operated vacuum pump which produces the required suction in the fixed ports 84 and 85 of the knotter 81 and in the mobile port 91 which seizes the yarn end on the bobbin side. There is also located on the carriage an inverter controlling the geared motor 46 so that it undergoes the required acceleration and braking, and the normal or reduced running speed. The PLC is programmed to execute either the rejoining cycle or the doffing cycle according to the signal which it receives from the signal device 48.

Each cycle proceeds by steps in predetermined time sequence, each successive step being enabled by the receipt of a signal confirming execution of the preceding step, from sensors provided for this purpose.

The units which execute the various stages of the described cycles have electromechanical or pneumatic drives. In the case of the pneumatic drives the PLC feeds command signals to solenoid valves which then control pneumatic cylinders for driving the equipment. In the case of the electromechanical drives the PLC feeds command signals to relays which then power direct current electric motors coupled to precision reduction gears, themselves coupled to preset clutches which act when the resisting torque exceeds a predetermined allowable value, and to electromagnetic brakes which precisely brake the various moving members in order to overcome the problems deriving from the inertia of the geared motor unit. The duration of each of the two cycles can be varied by adjusting the duration of the individual stages in order to adapt them to the technical requirements of the yarn being worked, while respecting the order of precedence in which the various members act.

The present invention has considerable advantages over twisting machines of the known art.

The automatic carriage according to the invention does not require substantial modifications to the overall architecture of the twisting frame or its dimensions, and involves no alteration at all in the small dimensions of the individual twisting stations. The operations which have been automated are precisely the most fatiguing and delicate carried out in the upper part of the twisting station.

The operator has now only to insert the feed yarn and check the reason for the stoppage of the station.

The consequent labour reduction is considerable and of the order of 50%, so that one operator can control double the number of twisting stations with less effort and attention. That portion of the yarn in which the interruption occurred is now of improved quality because of the rigorously constant times of the various operating stages and the constant twists which are also induced in the joined portion, especially if a pneumatic yarn joiner is used.

There is also considerable resultant simplicity and economy in the operations involved in starting and restarting the machine, which can be done in sequence for the various stations by one operator with the aid of the automatic carriage instead of by the so-called "American" system, in which a whole team of operators starts a whole machine in one go.

We claim:

1. An automatic device for restarting a two-for-one twisting station and restoring yarn continuity between a feed and a bobbin on which yarn is wound, said station comprised of a feed side comprised of a feed source of at least two yarns to be twisted, a bobbin side comprised of a means to accumulate twisted yarn, and a twisting action assembly between said feed side and said bobbin side, said device being responsive to a call signal from said twisting station and disposed on a carriage which patrols twisting machine faces along which the twisting stations are aligned, characterized in that the automatic device selectively effects the operations involved in the restarting cycle and the rejoining cycle in accordance with a predetermined sequence;

means for discharging a full bobbin onto means for unloading said bobbin;

means for raising and lowering a bobbin carrier arm and for opening holding centres which hold a tube on which the bobbin is wound;

means for retaining and delivering the at least two yarns, wherein the yarns on the feed side are manually insertable and are clamped therein;

means for seizing the yarns on the feed side from said retention and delivery means, said seizing means selectively conveying the yarns either to between the holding centres in case of a doffing cycle or into a joining device in the case of a joining cycle, said seizing means comprising an extendable arm provided with a gripper at one end, said gripper operated by a servo control, and said arm divided into two hinged together parts of which at least one part can assume either an extended position or a plurality of positions folded through an angle relative to the other part so as to reduce its overall length and thus avoid obstacles existing in its path, and wherein said seizing means is pivotable from a first position proximate said retention and delivery means to a second position, wherein said second position enables trapping the twisted yarn between said bobbin and one of the holding centres, and to a third position for rejoining the yarn ends at the feed side of the bobbin at said joining device;

means for taking a new tube and positioning it between the holding centres;

means for seeking the yarn on the bobbin side and positioning it in said joining device when the yarns are to be rejoined in the rejoining cycle;

means for joining the yarn on the bobbin side to the yarns on the feed side;

control means for restarting the twisting action assembly; and means for clearing the call signal.

2. An automatic device for restarting a two-for-one twisting station as claimed in claim 1, characterized by comprising means for deviating the yarn so that it winds about an end of the tube to form a yarn reserve for subsequent formation of the bobbin.

3. The device of claim 1, further comprising a sickle-shaped finger for conveying the yarn toward a deviation roller for engagement thereto.

4. An automatic device for restarting a two-for-one twisting station as claimed in claim 1, characterised in that the joining device consists of a mechanical knotter or a pneumatic yarn joiner to which the yarn ends to be joined are presented.

5. An automatic device for restarting a two-for-one twisting station as claimed in claim 4, characterised in that the yarn ends are presented to the joining device parallel to each other but in mutually opposite directions.

6. An automatic device for restarting a two-for-one twisting station as claimed in claim 4, characterized in that the joining device is combined with sickle shaped introduction members which position the yarn ends in lead-ends provided for the yarn ends from the feed side and bobbin side respectively.

7. The apparatus of claim 1, wherein said retaining and delivering means comprises:

(a) means for releasably gripping the two ends of the yarn; and (b) a shaped plate, said shaped plate being disposed between the means for releasably gripping and the feed sources of the at least two yarns, said shaped plate including an aperture across which the at least two yarns span, said aperture being of sufficient shape and dimension as to give access for seizing the releasably gripped yarn ends by said seizing means.

* * * * *